US009796930B2

(12) United States Patent
Spence et al.

(10) Patent No.: US 9,796,930 B2
(45) Date of Patent: Oct. 24, 2017

(54) BITUMEN PRODUCTION FROM SINGLE OR MULTIPLE OIL SAND MINES

(71) Applicant: SYNCRUDE CANADA LTD. in trust for the owners of the Syncrude Project as such owners exist now, Fort McMurray (CA)

(72) Inventors: Jonathan Spence, Edmonton (CA); Yin Ming Samson Ng, Sherwood Park (CA); Robert Siy, Edmonton (CA); Barry Bara, Edmonton (CA); Jun Long, Edmonton (CA); Kevin Reid, Edmonton (CA); James Lorentz, Fort McMurray (CA); Shane Hoskins, Edmonton (CA)

(73) Assignee: SYNCRUDE CANADA LTD. in trust for the owners of the Syncrude Project as such owners exist now and in the future, Fort McMurray (CA)

( * ) Notice: Subject to any disclaimer, the term of this patent is extended or adjusted under 35 U.S.C. 154(b) by 35 days.

(21) Appl. No.: 14/860,493

(22) Filed: Sep. 21, 2015

(65) Prior Publication Data

US 2017/0081592 A1 Mar. 23, 2017

(51) Int. Cl.
*C10G 1/04* (2006.01)

(52) U.S. Cl.
CPC ..... *C10G 1/047* (2013.01); *C10G 1/045* (2013.01)

(58) Field of Classification Search
CPC ..... C10G 1/047
See application file for complete search history.

(56) References Cited

U.S. PATENT DOCUMENTS

| | | | | |
|---|---|---|---|---|
| 5,039,227 | A | 8/1991 | Leung et al. | |
| 9,068,124 | B2 | 6/2015 | Spence et al. | |
| 2013/0256196 | A1* | 10/2013 | Spence | C10G 1/047 208/391 |

FOREIGN PATENT DOCUMENTS

| | | | |
|---|---|---|---|
| CA | 2029795 | A1 | 5/1991 |
| CA | 2217623 | A1 | 4/1999 |
| CA | 2480122 | A1 | 3/2006 |
| CA | 2506398 | A1 | 11/2006 |
| CA | 2810730 | A1 | 9/2013 |

* cited by examiner

*Primary Examiner* — Randy Boyer
(74) *Attorney, Agent, or Firm* — Bennett Jones LLP

(57) ABSTRACT

A process for operating multiple oil sand mine sites for extracting bitumen from oil sand is disclosed, comprising preparing a first conditioned oil sand slurry at a first location using a first oil sand slurry preparation and slurry conditioning process; preparing a second conditioned oil sand slurry at a second location using a second oil sand slurry preparation and slurry conditioning process; combining the first conditioned oil sand slurry and the second conditioned oil sand slurry in at least one slurry distributor to produce a combined oil sand slurry; and distributing the combined oil sand slurry to at least one separation vessel to produce bitumen froth.

5 Claims, 6 Drawing Sheets

BITUMEN PRODUCTION FROM SINGLE OR MULTIPLE OIL SAND MINES

FIELD OF THE INVENTION

The present invention relates generally to the extraction of bitumen from oil sand and, more particularly, to a process and process line for combining a number of oil sand slurry preparation, slurry conditioning and separation processes into a unified operation.

BACKGROUND OF THE INVENTION

The oil sands in Northern Alberta constitute one of the largest hydrocarbon reserves in the world. Oil sands are a combination of bitumen, quartz sand, clay, water and trace minerals. Bitumen can be recovered from oil sands using two main methods: open-pit mining and in situ drilling. Approximately 20% of the oil sands lie close enough to the earth's surface to be mined.

The key characteristic of Alberta oil sand that makes bitumen economically recoverable is that the sand grains are hydrophilic and encapsulated by a water film which is then covered by bitumen. The water film prevents the bitumen from being in direct contact with the sand and, thus, by slurrying mined oil sand with heated water, the bitumen is liberated from the sand grains and moves to the aqueous phase. However, the composition of oil sands varies from deposit to deposit and the recovery of bitumen from a particular deposit will depend on a number of factors including the grade of the oil sand, i.e., the bitumen content, the fines content, the connate water chemistry, the minimum mining thickness, and the ratio of total volume to bitumen in place. Hence, various processing conditions have been developed for successful extraction of bitumen from oil sands, which processing conditions will be discussed in more detail below.

It is well understood in the industry that the quality of the oil sand has very significant effects on bitumen recovery. For example, a "low grade" oil sand typically contains between about 6 to 10 wt. % bitumen with greater than about 25 wt. % fines. An "average grade" oil sand typically contains at least 10 wt. % bitumen to about 12.5 wt. % bitumen with about 15 to 25 wt. % fines and a "high grade" oil sand typically contains greater than 12.5 wt. % bitumen with less than 15 wt. % fines. Fines are generally defined as those solids having a size less about 44 μm. The higher fines concentration in low to average grade oil sand contributes to the difficulty in extracting the bitumen.

Further, final mine pit limits are also influenced by physical limits such as lease limits, roadways, river courses, plant facilities, and associated necessary geotechnical offsets. The requirements for power lines, pipeline corridors, communication lines, ditches, heavy equipment haul roads, light vehicle access roads, etc. are all incorporated into mining limits. Thus, generally, each mine pit (site) will have its own individual unique limitations to overcome.

In view of all of the above, several different bitumen extraction processes have been developed to deal with variations in oil sand ore at various mine sites as well as other limitations as listed above. An oil sands bitumen extraction process generally includes the following steps: preparing an oil sand and water slurry from mined oil sand (slurry preparation), conditioning the oil sand slurry (slurry conditioning), and subjecting the oil sand slurry to a separation process to recover the bitumen (bitumen separation) (collectively referred to generally as "bitumen extraction process").

As used herein "slurry preparation" means the preparation of a water and oil sand slurry in a slurry preparation unit. As used herein, "slurry conditioning" means the digestion of oil sand lumps present in the oil sand slurry, liberation of bitumen from sand-fines-bitumen matrix, coalescence of liberated bitumen flecks into larger bitumen droplets and aeration of bitumen droplets. As used herein, "bitumen separation" means the separation of bitumen from the solids and water present in the conditioned oil sand slurry, commonly in a separation vessel such as a gravity separator.

One bitumen extraction process commonly used in the industry is referred to herein as the "hot water process". In general terms, the hot water process involves feeding the mined oil sand into a rotating tumbler where it is mixed for a prescribed retention time (generally in the range of 2 to 4 minutes) with hot water (approximately 80-90° C.), steam, caustic (e.g., sodium hydroxide) and naturally entrained air to yield a slurry that has a temperature typically around 80° C. The bitumen matrix is heated and becomes less viscous. Chunks of oil sand are ablated or disintegrated. The released sand grains and separated bitumen flecks are dispersed in the water. To some extent bitumen flecks coalesce and grow in size. They may contact air bubbles and coat them to become aerated bitumen (slurry conditioning). Thus, in the hot water process, both oil sand slurry preparation and slurry conditioning occur in the tumbler.

The conditioned slurry is introduced into a separation vessel typically operating at 55 to 80° C. to recover the bitumen. One of the limitations of the hot water process is that, in general, such a tumbler based plant is at a fixed location, ideally, one where large amounts of hot water/steam can be produced.

The hot water process generally produces good bitumen recoveries for all grades of oil sand. However, the thermal energy requirement per tonne of oil sand processed is very high. In particular, thermal energy is required to heat the process water, for steam production and for heating the flood water. Thus, the hot water process may only be practiced at particular mine sites due to such limitations.

Another bitumen extraction process, which is disclosed in Canadian Patent No. 2,029,795 and U.S. Pat. No. 5,039,227, involves the use of a pipeline to condition oil sand slurry. In this process, heated water (typically at 95° C.) is mixed with the dry as-mined oil sand at the mine site in predetermined portions using a device known as a "cyclofeeder", to form an aerated slurry having a temperature in the range of 40-70° C., preferably about 50° C. (slurry preparation). The oil sand slurry is then conditioned through several kilometers of pipeline (slurry conditioning) and transported to an extraction plant where bitumen separation occurs typically at 55° C. in a separation vessel. This extraction process is referred to herein as the "warm slurry process".

Because of the use of a hydrotransport pipeline to condition the oil sand slurry, the warm slurry process allows for more flexibility, e.g., the mine site may be more remotely located from a bitumen separation plant where bitumen froth is produced from the conditioned oil sand slurry. Furthermore, in warm slurry extraction, the slurry preparation unit is generally relocatable and can be moved when required. The hydrotransport pipeline which is used for conditioning can also be moved when required.

Thus, in the warm slurry process, the pumping of the slurry through a pipeline, over a certain distance, allows the slurry to be conditioned at a lower temperature of about 50 to 55° C. With increased conditioning time (i.e., typically 10 minutes or greater) in the pipeline, this process does not compromise conditioning and bitumen recovery. Further, this process allows the slurry preparation at the mine site and the bitumen separation at the bitumen separation plant, thereby reducing the requirement of dry oil sand transportation. Hence, the warm slurry process generally has a reduced carbon footprint and a reduced energy requirement.

In some instances, for example, at very remote mine sites where access to thermal energy is limited, it is desirable to reduce the thermal energy requirement per tonne of oil sand even more. Thus, an even lower energy consuming bitumen extraction process was developed, which is disclosed in Canadian Patent Nos. 2,217,623 and 2,506,398, and which is hereinafter referred to as the "low energy process", i.e., a process where slurry preparation and conditioning typically results in an oil sand slurry having a temperature in the range of about 40-55° C. The low energy process involves mixing the mined oil sand with water having a temperature of about 75-85° C. in predetermined proportions in a mix box located near the mine site to produce a slurry containing entrained air and having a controlled density in the range of 1.5 to 1.6 g/cc. The slurry is then pumped through a pipeline to condition and transport the slurry (slurry conditioning). The separation of bitumen from the conditioned slurry typically occurs at about 35° C.

As mentioned, this process is particularly useful for mine locations where there is limited access to hot water and steam and, in particular, at remote mine locations. Because hot water is heated locally, i.e., requiring a power generation system, a mine site can be located far away from the base plant where bitumen froth cleaning and upgrading take place.

It is understood that other slurry preparation units can be used, such as the unit described in Canadian Patent Application No. 2,480,122. When using this slurry preparation unit, little or no rejects will be produced during slurry preparation. The slurry preparation unit comprises a series of roll crushers spread vertically throughout a portion of a slurry preparation tower. The slurry preparation tower typically uses gravity to move the oil sand through the tower. Typically, each roll crusher is made up of a number of crusher rolls spaced a certain distance apart to reduce the size of large pieces of oil sand before the lumps of oil sand drop through the crusher rolls to the next roller crusher beneath or at the bottom of the slurry preparation tower. Each successively lower roll crusher reduces the lumps of oil sand even smaller until the oil sand is fine enough to form a pumpable oil sand slurry.

At the same time the oil sand passes through the different roll crushers, heated water is added to the oil sand to form a slurry. Typically, the stream of oil sand passing through the levels of roll crushers is sprayed with the heated water, as it passes down the tower. The mixing of this oil sand with the streams of hot water will form the eventual oil sand slurry, which is typically received in a pump box for feeding the slurry to a pump and pipeline system. This process reduces the bitumen loss to the rejects due to the decreased amount of rejects, thus allowing more bitumen to be recovered. This process is particularly useful when it is desirable to produce minimal rejects and is hereinafter referred to as the "wet crushing slurry preparation process".

In summary, selection of a particular slurry preparation process, slurry conditioning process, and bitumen separation process will depend on a number of factors, including the remoteness of the mine site, the ability and cost to truck mined oil sand to the slurry preparation units and the energy availability at the mine site.

SUMMARY OF THE INVENTION

In one aspect, the present invention is directed to a process and process line for combining a number of different oil sand slurry preparation and slurry conditioning processes (collectively referred to "slurry preparation and conditioning processes") with a common bitumen separation process to provide a unified operation and allow the operator to process oil sands in multiple mines in multiple locations more effectively, efficiently, and economically. For example, having the ability to operate a number of slurry preparation and conditioning processes at different temperatures and at different mine sites allows an operator to utilize its resource more efficiently by making maximum use of the heat available at each mine site. However, there is still a need to be able to unify the various slurry preparation and conditioning processes with common bitumen separation processes to allow an operator to maximize bitumen recovery.

In another aspect, there is a need to ensure that the downstream bitumen processing (upgrading) capacity is fully utilized. Thus, there is a need to unify bitumen froth treatment processes for the bitumen froth products formed in bitumen separation processes.

In another aspect, there may be instances where there are multiple trains of the same slurry preparation and conditioning process operating at the same mine site and it is also desirable to unify these multiple trains operating at a single mine site, in addition to unifying multiple mine sites.

In accordance with one aspect of the invention, a process is provided for extracting bitumen from oil sand, comprising:

- preparing a first conditioned oil sand slurry at a first location using a first slurry preparation and conditioning process;
- preparing a second conditioned oil sand slurry at a second location using a second slurry preparation and conditioning process;
- combining the first conditioned oil sand slurry and the second conditioned oil sand slurry in at least one slurry distributor to produce a combined oil sand slurry; and
- distributing the combined oil sand slurry to at least one separation vessel to produce bitumen froth.

In one embodiment, the combined oil sand slurry is distributed to at least two separation vessels and the bitumen froths from the at least two separation vessels are combined in at least one froth storage tank for further treatment. In one embodiment, the separation vessel is a gravity separation vessel.

In one embodiment, the first location and the second location are at a single mine site. In another embodiment, the first location and the second location are at different mine sites.

In one embodiment, the first slurry preparation and conditioning process and the second slurry preparation and conditioning process are the same. In another embodiment, the first slurry preparation and conditioning process and the second slurry preparation and conditioning process are different.

In one embodiment, bitumen froth is deaerated prior to storage in at least one froth storage tank. In one embodiment, the bitumen froth in the at least one froth storage tank is subjected to further treatment to reduce the solids and water content therein. In one embodiment, the treatment comprises naphtha froth treatment. In another embodiment, the treatment comprises paraffinic froth treatment.

In accordance with another aspect of the invention, a process is provided for operating multiple oil sand mine sites for extracting bitumen from oil sand, comprising:

preparing a first conditioned oil sand slurry at a first mine site using a first slurry preparation and conditioning process and subjecting the first conditioned oil sand slurry to a first bitumen separation process to produce a first bitumen froth;

preparing a second conditioned oil sand slurry at a second mine site using a second slurry preparation and conditioning process and subjecting the second conditioned oil sand slurry to a second bitumen separation process to produce a second bitumen froth;

combining the first bitumen froth and the second bitumen froth in at least one froth storage tank to produce a combined bitumen froth; and subjecting the combined bitumen froth to further treatment to reduce the solids and water content therein.

In one embodiment, the first bitumen froth and the second bitumen froth are deaerated prior to combining them in the at least one froth storage tank. In one embodiment, the first bitumen froth is heated prior to combining it with the second bitumen froth. In one embodiment, the first mine site is remote from the second mine site and the first bitumen froth is transported to the second mine site by means of a froth pipeline.

In accordance with another aspect of the invention, a process is provided for operating multiple oil sand mine sites for extracting bitumen from oil sand, comprising:

preparing a first conditioned oil sand slurry at a first mine site using a first slurry preparation and conditioning process and subjecting the first conditioned oil sand slurry to a first bitumen separation process to produce a first bitumen froth;

transporting the first bitumen froth to a second mine site by means of a froth pipeline and combining the first bitumen froth with oil sand ore mined at the second mine site and water; and preparing a second conditioned oil sand slurry from the combined first bitumen froth, the oil sand ore mined at the second mine site and water using a second slurry preparation and conditioning process and subjecting the second conditioned oil sand slurry to a second bitumen separation process to produce a second bitumen froth.

In one embodiment, the combined second slurry preparation and conditioning process and second bitumen separation process is a hot water process. In another embodiment, the combined first slurry preparation and conditioning process and the first bitumen separation process is a low energy process.

BRIEF DESCRIPTION OF THE DRAWINGS

The following drawings form part of the specification and are included to further demonstrate certain embodiments or various aspects of the invention. In some instances, embodiments of the invention can be best understood by referring to the accompanying drawings in combination with the detailed description presented herein. The description and accompanying drawings may highlight a certain specific example, or a certain aspect of the invention. However, one skilled in the art will understand that portions of the example or aspect may be used in combination with other examples or aspects of the invention.

DESCRIPTION OF THE PREFERRED EMBODIMENT

The invention is exemplified by the following description and examples.

Figure 1:
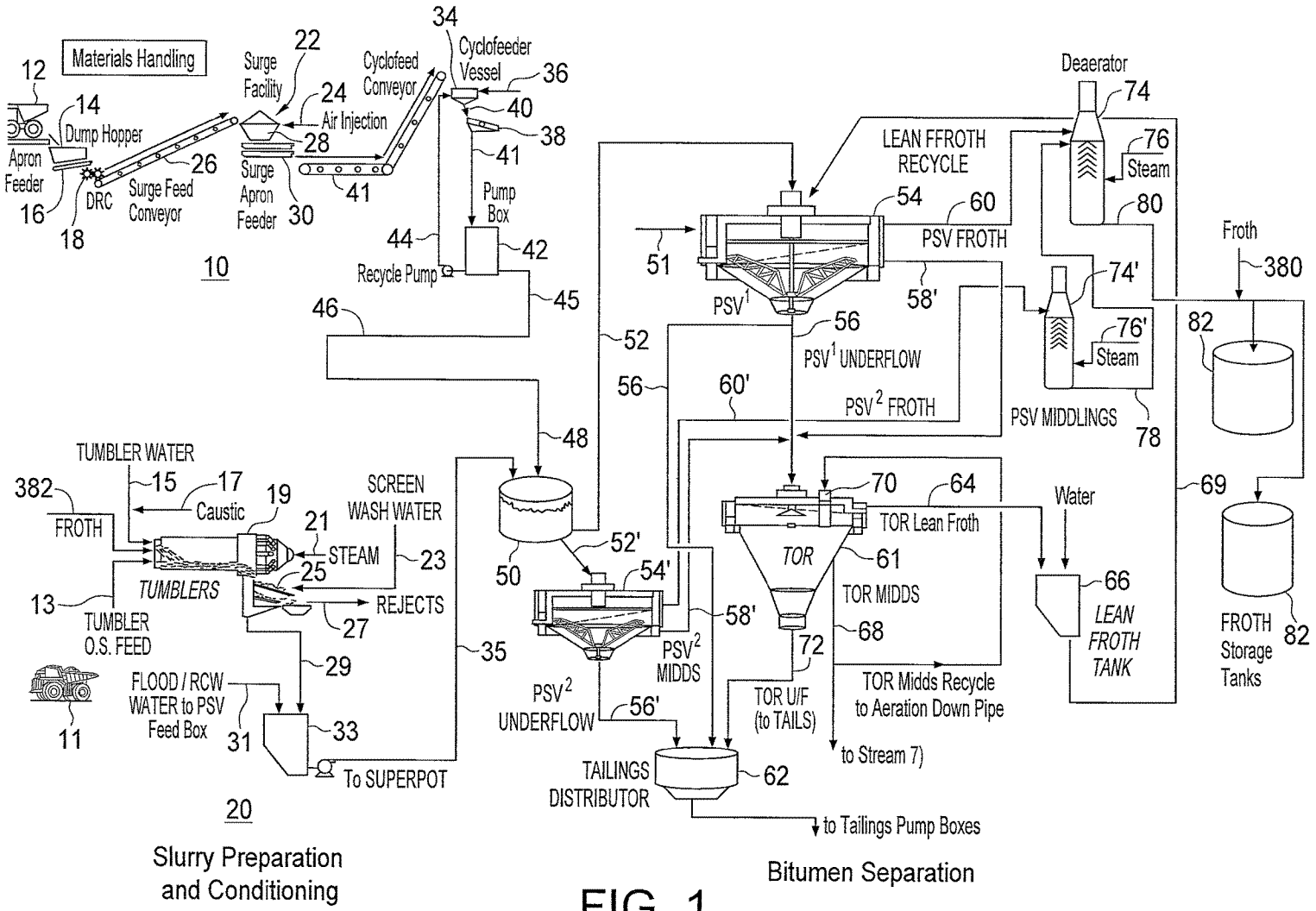
FIG. 1 is a schematic of two different slurry preparation and conditioning processes which are combined into a unified operation by a common bitumen separation process in accordance with an embodiment of the invention.

A schematic of two different slurry preparation and conditioning process trains, train 10 and train 20, operating at two different mine sites that are integrated according to the present invention is shown in FIG. 1. Train 10 depicts a remote slurry preparation and conditioning process, which uses hydrotransport to condition oil sand slurry at ~50° C. (as described in the warm slurry process). Train 20 depicts a slurry preparation and conditioning process where oil sand slurry is conditioned in a tumbler at ~80° C. (as described in the hot water process). While the two slurry preparation and conditioning process trains operate at different mine sites or different parts of the same mine, the conditioned oil sand slurries produced at each site are combined allowing bitumen separation to occur at a single bitumen extraction plant, as will be described in more detail below.

Train 10 comprises mined oil sand being delivered by trucks 12 to a hopper 14 having an apron feeder 16 therebelow for feeding mined oil sand to a double roll crusher 18 to produce pre-crushed oil sand. Surge feed conveyor 26 delivers pre-crushed oil sand to surge facility 22 comprising surge bin 28 and surge apron feeders 30 therebelow. Air 24 is injected into surge bin 28 to prevent the oil sand from plugging.

The surge apron feeders 30 feed the pre-crushed oil sand to cyclofeeder conveyer 32, which, in turn, delivers the oil sand to cyclofeeder vessel 34 where the oil sand and water 36 are mixed to form oil sand slurry 40. Oil sand slurry 40 is then screened in screen 38 and screened oil sand slurry 41 is transferred to pump box 42. The cyclofeeder system is described in U.S. Pat. No. 5,039,227. Optionally, oversize lumps from screens 38 are sent to secondary reprocessing (not shown). Oil sand slurry 45 is then conditioned by pumping the slurry through a hydrotransport pipeline 46, from which conditioned oil sand slurry 48 is delivered to slurry distribution vessel 50 (also referred to herein as "superpot"). A portion of oil sand slurry 44 can be recycled back to cyclofeeder 34.

Train 20 comprises tumbler oil sand feed 13 being delivered by truck 11 and fed into tumbler 19. Tumbler hot water 15, caustic 17 (e.g., sodium hydroxide) and steam 21 are also added to tumbler 19 where the oil sand is mixed with the water to form a conditioned oil sand slurry. Residence time of the slurry in the tumbler is generally around 2.0 to 4.0 minutes. The slurry is then screened through reject screens 25 and rejects 27 are discarded. Screened conditioned oil sand slurry 29 is then transferred to a pumpbox 33 where additional water 31 may be added. The slurry 35 is then pumped to slurry distribution vessel 50.

Distribution vessel 50 is designed to mix the incoming flows, slurry 48 and slurry 35, to give a homogeneous slurry for further distribution. In one embodiment, slurry distribution vessel 50 is a passive vessel, meaning that no impellers are used. Hence, at this point, trains 10 and 20 are unified and a homogeneous slurry is formed so that bitumen separation can take place at a common bitumen separation plant to produce a more consistent quality of bitumen froth.

In one embodiment, the bitumen separation plant comprises at least one primary separation vessel, or "PSV". A PSV is generally a large, conical-bottomed, cylindrical vessel. In the embodiment shown in FIG. 1, slurry is distributed by the slurry distribution vessel 50 to two PSVs 54, 54' via slurry streams 52, 52'. The slurry 52, 52' is retained in the PSV 54, 54' under quiescent conditions for a prescribed retention period. During this period, the aerated bitumen rises and forms a froth layer, which overflows the top lip of the vessel and is conveyed away in a launder to produce bitumen froth 60, 60'. The sand grains sink and are concentrated in the conical bottom—they leave the bottom of the vessel as a wet tailings stream 56, 56'. Middlings 58, 58', a mixture containing fine solids and bitumen, extend between the froth and sand layers.

Some or all of tailings stream 56 and middlings 58, 58' are withdrawn, combined and sent to a secondary flotation process carried out in a deep cone vessel 61 wherein air is sparged into the vessel to assist with flotation of remaining bitumen. This vessel is commonly referred to as a tailings oil recovery vessel, or TOR vessel. The lean bitumen froth 64 recovered from the TOR vessel 61 is stored in a lean froth tank 66 and the lean bitumen froth 64 may be recycled to the PSV feed. The TOR middlings 68 may be recycled to the TOR vessel 61 through at least one aeration down pipe 70. TOR underflow 72 is deposited into tailings distributor 62, together with tailings streams 56, 56' from PSVs 54 and 54', respectively. It is understood, however, that other bitumen separation processes can be used in the present invention to unify separate mining sites. It is also understood that a bitumen separation process can be comprised of multiple pieces of equipment, for example, multiple primary separation vessels, and multiple tailings oil recovery vessels.

PSV 54 bitumen froth 60 is then deaerated in steam deaerator 74 where steam 76 is added to remove air present in the bitumen froth. Similarly, PSV 54' bitumen froth 60' is deaerated in steam deaerator 74' where steam 76' is added. Deaerated bitumen froth 78 from steam deaerator 74' is added to steam deaerator 74 and a final deaerated bitumen froth product 80 is stored in at least one froth storage tank 82 for further treatment. A typical deaerated bitumen froth comprises about 60 wt % bitumen, 30 wt % water and 10 wt % solids.

Currently, two different types of froth treatment processes are commercially employed; naphthenic froth treatment, which uses a naphtha diluent typically obtained from the downstream coking of bitumen, and paraffinic froth treatment, which uses a paraffinic diluent composed of a mixture of hexanes and pentanes. Froth treatment involves the removal of water and solids still present in the deaerated bitumen froth to produce a bitumen product for upgrading.

Figure 2:
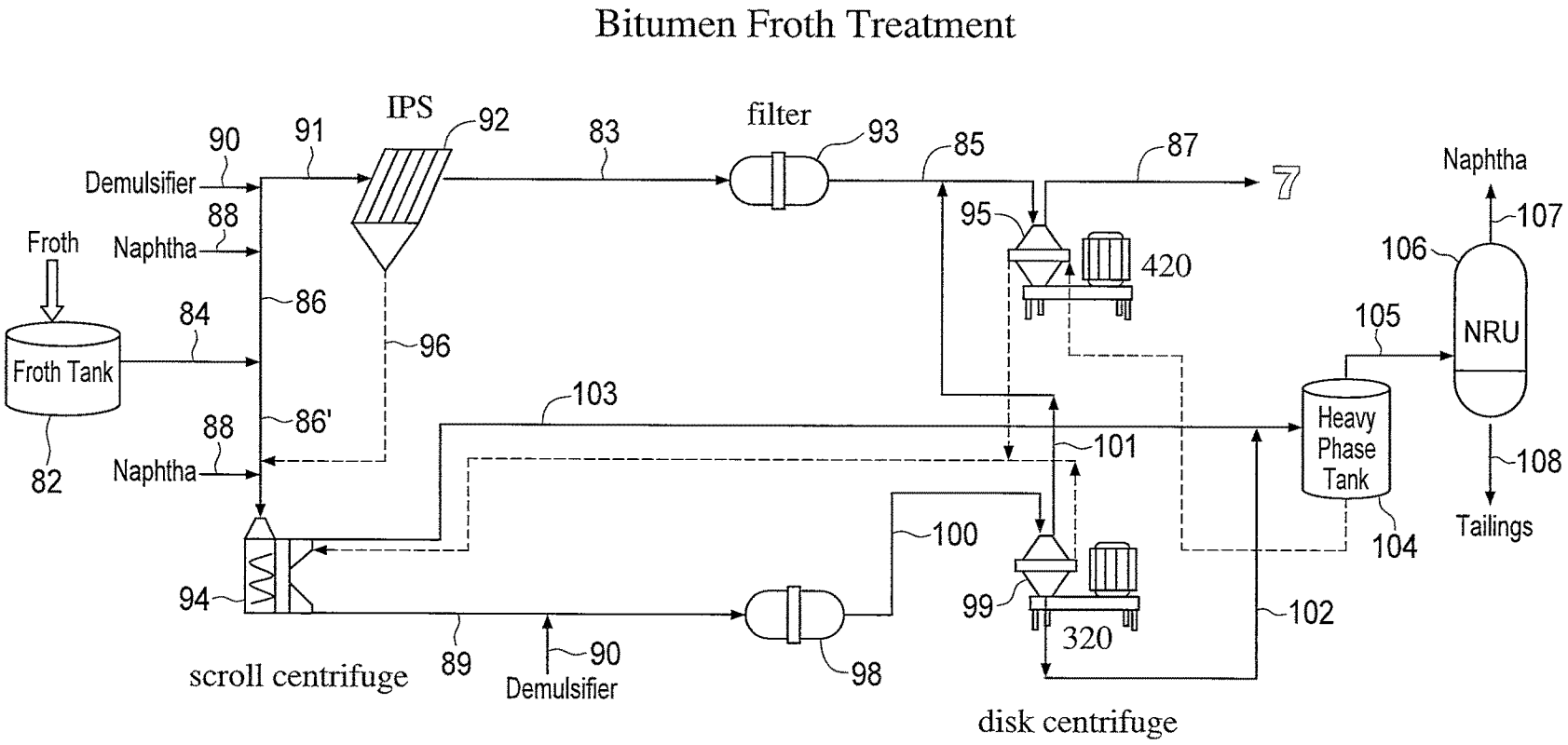
FIG. 2 is a schematic of a bitumen froth treatment process useful in the present invention.

A naphthenic froth treatment process useful in the present invention is shown in FIG. 2. It is understood, however, that other froth treatment processes can be used. Bitumen froth 84 stored in froth tank 82 can be split into two separate streams, streams 86, 86'. Naphtha 88, generally at a diluent/bitumen ratio (wt./wt.) of about 0.4-1.0, preferably, around 0.7, and a demulsifier 90 are added to bitumen froth stream 86 to form a diluted froth stream 91 which is then subjected to separation in an inclined plate settler 92 (IPS). The IPS 92 acts like a scalping unit to produce an overflow 83 of diluted bitumen and an underflow 96 comprising water, solids and residual bitumen.

Overflow 83 is then filtered in a filter 93 such as a Cuno filter to remove oversize debris still present in the diluted bitumen 83. Filtered diluted bitumen 85 is further treated in a disc centrifuge 95 which separates the diluted bitumen from the residual water (and fine clays) still present. A disc machine separates the hydrocarbon from the water in a rotating bowl operating with continuous discharge at a very high rotational speed. Sufficient centrifugal force is generated to separate small water droplets, of particle sizes as small as 2 μm to 5 μm, from the diluted bitumen.

The final diluted bitumen product 87 typically comprises between about 0.5 to 0.8 wt. % solids and 2.0-5.0 wt. % water and bitumen recovery is about 98.5%.

Deaerated bitumen froth stream 86' from froth tank 82 is also treated with naphtha at a diluent/bitumen ratio (wt./wt.) of about 0.4-1.0, preferably, around 0.7. The underflow 96 from IPS 92 can be added to stream 86' in order to recover any residual bitumen present in this underflow stream. The diluted bitumen froth is then treated in a decanter (scroll) centrifuge 94 to remove coarse solids from naphtha diluted froth. Decanter centrifuges are horizontal machines characterized by a rotating bowl and an internal scroll that operates at a small differential speed relative to the bowl. Naphtha-diluted froth containing solids is introduced into the centre of the machine through a feed pipe. Centrifugal action forces the higher-density solids towards the periphery of the bowl and the conveyer moves the solids to discharge ports.

The solids 103 are then fed to a heavy phase tank 104. The diluted bitumen 89 is further treated with a demulsifier 90, filtered in a filter 98 and the filtered diluted bitumen 100 is further treated in a disc centrifuge 99. The resultant diluted bitumen 101 is then treated, along with filtered diluted bitumen stream 85, in disc centrifuge 95 which separates the diluted bitumen from the residual water (and fine clays) still present to give final diluted bitumen stream 87. The solids 102 are also fed to heavy phase tank 104. The solids 105 are then treated in a naphtha recovery unit 106 where naphtha 107 is separated from the froth treatment tailings 108.

Thus, despite slurry preparation and conditioning occurring at two different mine sites using different slurry preparation and conditioning processes, the blending of the conditioned oil sand slurries in the slurry distributors (superpots) gives operational flexibility and improved bitumen extraction and separation through slurry blending. Having different slurry preparation and conditioning processes operating at different temperatures allows the operator to utilize the resource more efficiently, by maximizing use of the heat available at each mine site.

Further, the combination of bitumen extraction and froth treatment allows the operator to process oil sands in multiple mines in multiple locations. The pooling of bitumen froths in froth storage tanks maintains production capacity of the froth treatment facilities to produce diluted bitumen product. It also ensures that the downstream bitumen processing capacity is fully utilized.

In some instances, particularly where mine sites are very remote, it is more economical to transport bitumen froth rather than conditioned oil sand slurry, as is the case above. In particular, froth transportation using natural froth lubricity enables slurry preparation and conditioning and bitumen separation to occur remotely and the bitumen froth to be transported to a bitumen froth treatment plant at a different location, which increases production and maximizes the use of processing equipment. This aspect of the present invention will be discussed in more detail following.

Figure 3:
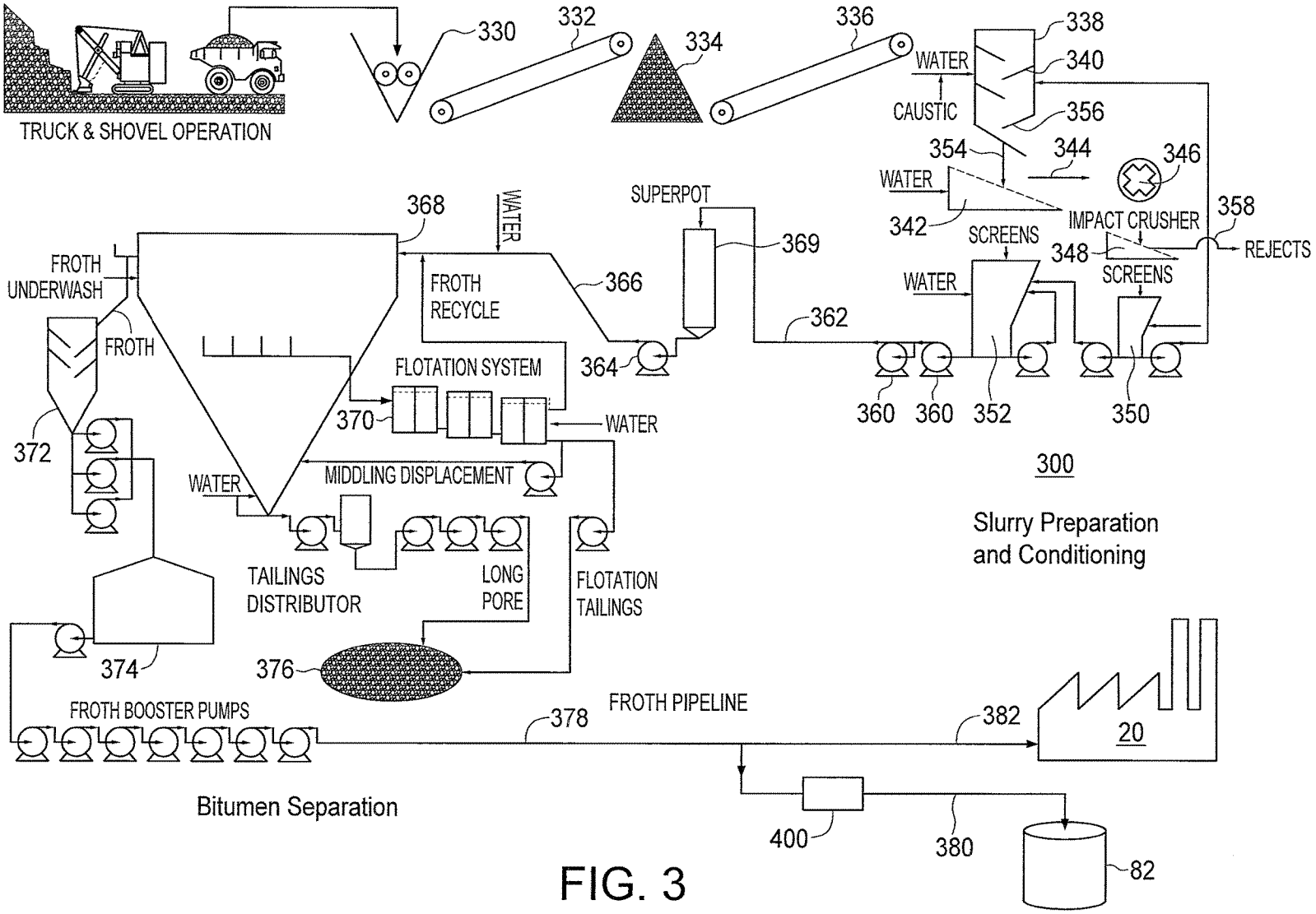
FIG. 3 is a schematic of a combined slurry preparation and conditioning process and bitumen separation process where the bitumen froth produced can be combined with FIG. 1.

In some embodiments, a third bitumen extraction process, for example, a low energy process, can be operating at yet another mine site. The low energy process can be tied into the process shown in FIG. 1 as follows. FIG. 3 shows a typical low energy process 300 which can be used at mine sites where heat is less available. In the low energy process, oil sand ore is surface mined using shovels and transported by trucks to be pre-crushed in a primary crusher 330, preferably a double roll crusher. Pre-crushed oil sand is then conveyed by conveyor 332 and stock piled until further use (surge pile 334). The pre-crushed oil sand is then conveyed by conveyor 336 to a mix box 338 where hot slurry water and caustic (e.g., sodium hydroxide) is added to form a slurry. Mix box 338 comprises a plurality of mixing shelves 340 to mix the oil sand with hot slurry water to produce oil sand slurry. Oil sand slurry 354 leaves the bottom outlet 356 of the mix box 338 as unscreened slurry 354 and is then screened using screen 342 where additional hot slurry water can be added. The screened slurry is then deposited in pump box 352.

Screened rejects 344 are fed to an impact crusher 346 and screened again through screen 348. Oversize rejects 358 are discarded but screened material enters pump box 350, where more water is added and then oil sand slurry is pumped into pump box 352. The oil sand slurry in pump box 352 is then pumped via pumps 360 through a hydrotransport pipeline 362 for conditioning to produce conditioned oil sand slurry.

If the mine site is very remote, i.e., it is too far away from an existing bitumen separation plant to make it economical to transport the conditioned oil sand slurry to the existing plant, a bitumen separation plant is also provided at or near the remote mine site. Conditioned oil sand slurry is transferred to slurry distributor 369 (superpot) and then pumped via pump 364 through a second section 366 of pipeline where cold flood water is added. Diluted slurry is then introduced into primary separation vessel (PSV) 368 and retained under quiescent conditions, to allow the solids to settle and the bitumen froth to float to the top. A froth underwash of hot water is added directly beneath the layer of bitumen froth to aid in heating the froth and improving froth quality.

Thus, a bitumen froth layer, a middlings layer and a solids layer are formed in the primary separation vessel 368. Middlings from primary separation vessel 368 are removed and undergo flotation in flotation cells 370 to produce secondary froth. Secondary froth is recycled back to the primary separation vessel 368. Tailings, comprising the solids, water, etc. that collects at the bottom of the primary separation vessel 368 are removed and deposited into tailings pond 376 or sent to a composite tailings plant.

Bitumen froth, or primary froth, is removed from the top of the primary separation vessel 368 and then deaerated in froth deaerator 372. Once deaerated, the primary froth can be retained in froth tank 374. The deaerated bitumen froth stored in froth tank 374 can then be pumped using froth booster pumps via froth pipeline 378. Because the deaerated bitumen froth contains about 20 to 40% by volume water and the water contains colloidal-size particles such as clay, deaerated bitumen froth can be transported for long distances through froth pipeline 378 by establishing self-lubricated core-annular flow. Water can be added to promote the transport of froth in the pipeline if insufficient water is present in the deaerated froth. Core-annular flow is described in more detail in U.S. Pat. No. 5,988,198.

In one embodiment, a portion of the deaerated bitumen froth in froth tank 374, referred to in FIG. 3 as deaerated bitumen froth 382, can be transported to another mine site and used in slurry preparation. For example, deaerated bitumen froth 382 can be fed directly into a hot water process, such as hot water process 20 shown in FIG. 1, to enhance the froth quality and to enrich a bitumen ore feed which may be a poor processing oil sand ore. As illustrated in more detail in FIG. 1, the deaerated bitumen froth 382 can be added to tumbler 19.

In addition, or, in the alternative, a portion of deaerated bitumen froth, referred to in FIG. 3 as deaerated bitumen froth 380, can be fed to froth storage tanks 82 (also shown in FIG. 1), which froth storage tanks may also store bitumen froth from hot water process 20 and warm slurry process 10, as shown in FIG. 1. Optionally, deaerated bitumen froth 380 can be heated in heater 400 prior to storage in storage tank 82. In one embodiment, deaerated bitumen froth is heated to a temperature greater than 35° C. In another embodiment, the deaerated bitumen froth 380 is heated to a temperature greater than 50° C.

Thus, in this embodiment, three different bitumen extraction processes have been linked together to form a single, uniform froth product for further treatment and upgrading.

In the low energy process, the temperature of the hot slurry water used in the slurry mixing step is generally about 75° C. to about 85° C., which, when mixed with the oil sand, results in an oil sand slurry having a temperature greater than 40° C., preferably greater than 43° C., and more preferably in the range of about 40° C. to about 55° C., and a density in the range of about 1.5 g/cc to about 1.6 g/cc. Caustic soda (NaOH) and other processing aids can be also added at this step, if necessary or desired.

The conditioning step can be performed either by pumping the oil sand slurry through a pipeline of sufficient length (e.g., typically greater than about 2.5 km) so that liberation of bitumen from sand and subsequent conditioning and aeration of bitumen both require sufficient time to occur. Preferably, conditioning time is about 10 minutes or more when using a pipeline of sufficient length.

The cold flood water temperature used in the flooding step generally ranges between 5° C. and 25° C., which results in a flooded or diluted slurry having a temperature of about 25° C. to about 40° C. and a density of about 1.4 g/cc to about 1.5 g/cc. More preferably, the diluted slurry will have a density of about 1.4 g/cc to about 1.45 g/cc and a temperature in the range of about 30° C. to about 40° C., preferably, a temperature of about 35° C. Use of cold flood water for flooding eliminates the need to heat water or import heated water from other sources, and readily available, lower quality pond water can be used.

Figure 4:
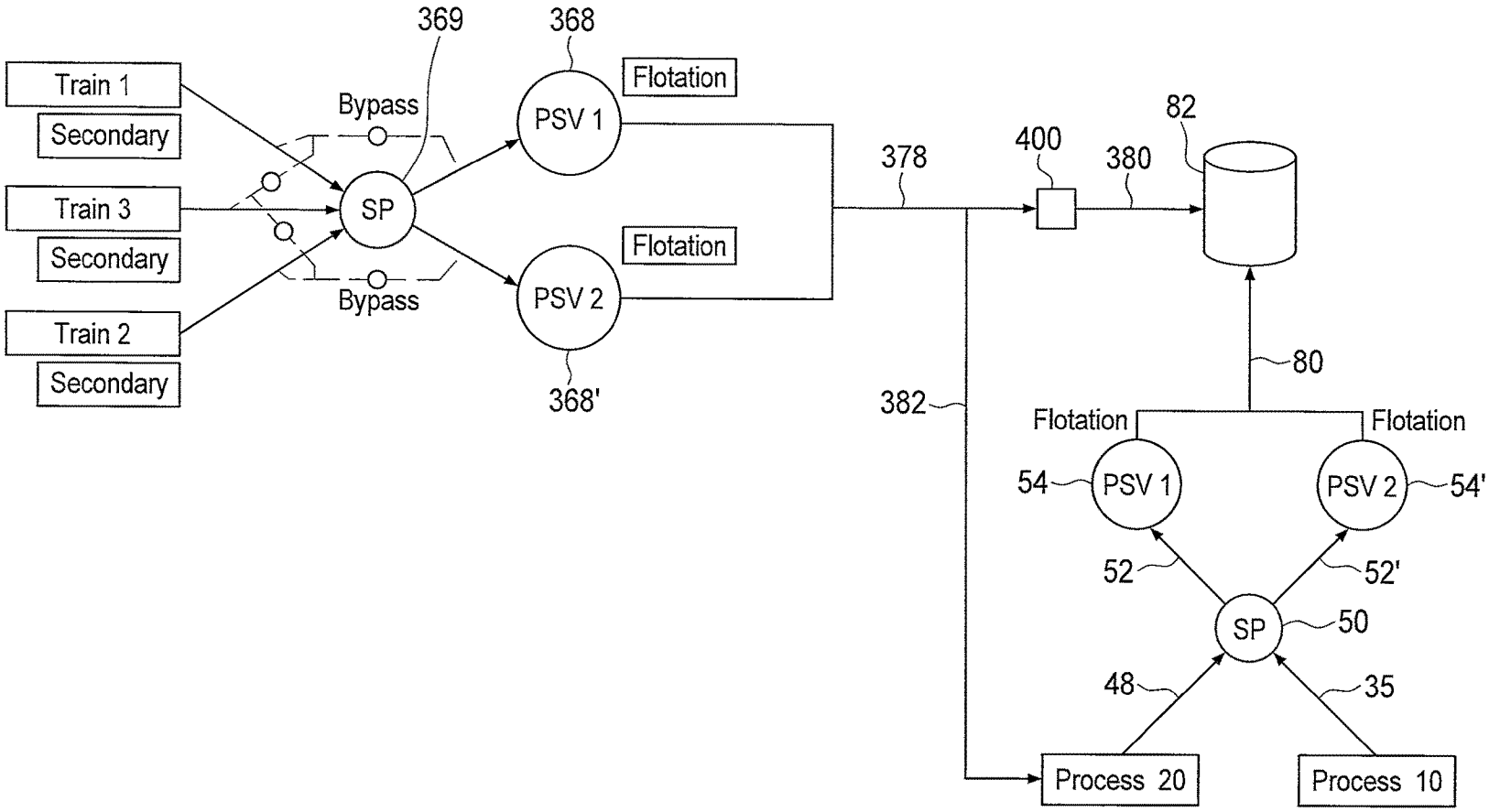
FIG. 4 is a block diagram showing the unification of three separate trains of the slurry preparation and conditioning process and the bitumen separation process, as shown in FIG. 3, with the processes of FIG. 1.

In one embodiment, at least two trains of low energy process may be operating at a single mine site to maximize separation (extraction) equipment usage. FIG. 4 illustrates three low energy slurry preparation and conditioning process trains, Train 1, Train 2 and Train 3, and two low energy bitumen separation trains, which are all integrated to produce a bitumen froth product. In particular, each of Trains 1, 2, and 3 represents a low energy slurry preparation and slurry conditioning process as illustrated in FIG. 3 and described above. Conditioned oil sand slurry produced in each of Train 1, Train 2 and Train 3 is pooled in slurry distributor 369 (also referred to as "superpot" or SP). It is understood, however, that all three trains need not be operating at all times and various bypass systems can be used when one or two trains is/are not being operated. The pooled conditioned oil sand slurry can then be subjected to bitumen separation, for example, flotation in at least one primary separation vessel 368, as illustrated in FIG. 3 and described above. However, it is understood that more than one primary separation vessel can be used. FIG. 4 illustrates two primary separation vessels being used, 368, 368'.

The bitumen froths produced from primary separation vessel 368 and primary separation vessel 368' are deaerated by steam, pooled and pumped through froth pipeline 378. A portion of the deaerated bitumen froth, 380, can be optionally heated using heater 400, and then stored in froth storage tank 82. Another portion of the deaerated bitumen froth, 382, can be added to hot water process 20 as described above.

FIG. 4 also illustrates how hot water slurry preparation and conditioning process 20 and warm slurry preparation and conditioning process 10 share a common bitumen separation process and, in addition, are integrated with low energy extraction process to produce a single deaerated bitumen froth product which can be stored in froth storage tank 82. Conditioned oil sand slurries 35, 48 are pooled into slurry distributor 50, subjected to flotation in primary separation vessels 54, 54', and the bitumen froths deaerated and pooled as deaerated bitumen froth product 80 and stored in froth storage tank 82 for further treatment and upgrading. Thus, in FIG. 4 it can been seen that three different slurry preparation and conditioning processes and two different bitumen separation processes can be used at three distinct mine sites but can also be integrated to produce a single, uniform bitumen froth product for further treatment and upgrading.

Figure 5A:
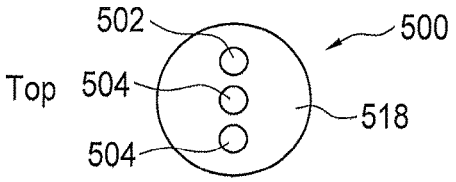
FIG. 5A, FIG. 5B, and FIG. 5C are a top view, front view and side view, respectively, of an embodiment of a slurry distributor useful in the present invention.
Figure 5B:
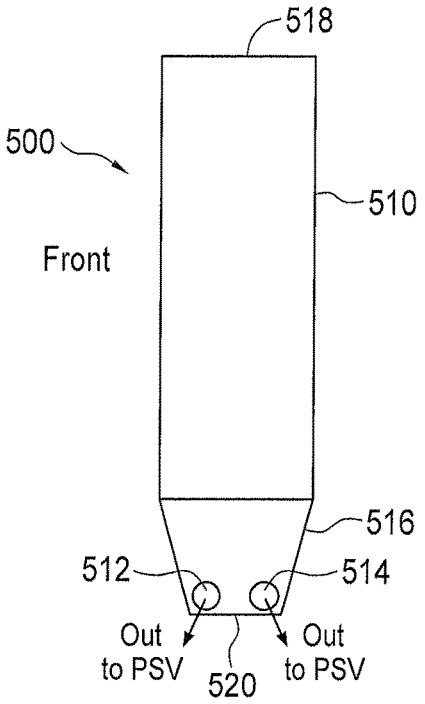
Figure 5C:
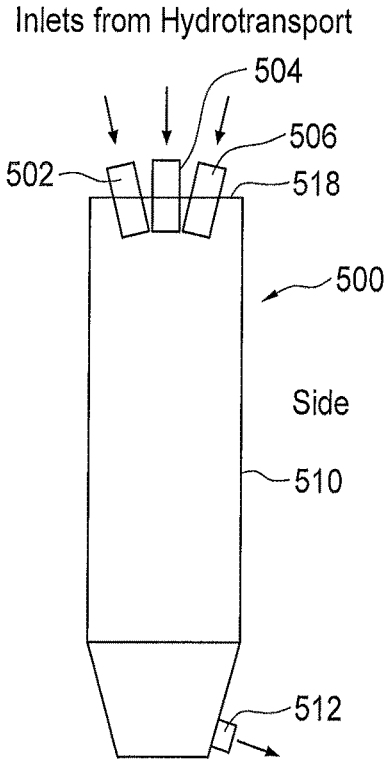

FIG. 5A, FIG. 5B and FIG. 5C are illustrations of a top view, front view and side view of a slurry distributor useful in the present invention. In general, slurry distributors are designed to mix incoming feed streams (e.g., conditioned slurries) to provide an even feed flow, with similar composition (i.e., air, solids, bitumen and water), at similar temperatures, to operating bitumen separation vessels such as primary separation vessels. Thus, for example, if one stream is warmer than the other two streams, the heat will be evenly distributed, which will result in better overall bitumen recovery.

Slurry distributor 500, shown in FIGS. 5A, 5B and 5C, is particularly useful when there are three feed lines for two outlets, as shown in FIG. 4 for the three trains, Train 1, Train 2 and Train 3. Slurry distributor 500 comprises a cylindrical body 510 having a inverted frustoconical bottom portion 516. Slurry distributor 500 further comprises three inlet pipes 502, 504 and 506 located at or near the top 518 of the slurry distributor 500. Generally, slurry distributor 500 is a closed top vessel having a large vent (not shown). The closed top prevents excessive steaming/heat loss and splashing from the jet mix zone, which prevents winter ice build up on vessel walls, pipes, instruments, and ramp/handle rails.

Optionally, each inlet pipe may terminate with a miter (not shown). Outer inlet pipes 502 and 506 are angled toward the central inlet pipe 504. Three conditioned oil sand slurries, which may come from three separate hydrotransport feed lines (not shown), will each be fed into one of the inlet pipes. Located at or near the closed bottom 520 of slurry distributor 500 are two outlet pipes 512 and 514, which outlets may be substantially perpendicular to central inlet pipe 504. Outlet pipes 512 and 514 distribute mixed conditioned slurry to two bitumen separation vessels, for example, two primary separation vessels (not shown), via attached outlet feed lines (not shown).

Slurry distributor 500 may be installed at ground level and the outlet streams of conditioned slurry may be pumped to the primary separation vessels' feedwells. The configuration of the inlet pipes 502, 504, 506 allows for more thorough mixing of the three conditioned slurry feed streams and having the inlet array rotated 90 degrees from the two outlets also increases mixing of the three conditioned slurries. Thus, a substantially homogeneous conditioned slurry product is formed, which contributes to a more consistent bitumen froth formation in the two primary separation vessels. It is understood, however, that not all incoming feed lines, which are attached to the inlet pipes, need to be operating at all times. Slurry distributor 500 allows the operator the flexibility to operate/switch incoming feed lines and outlet feed lines to the primary separation vessels.

Figure 6A:
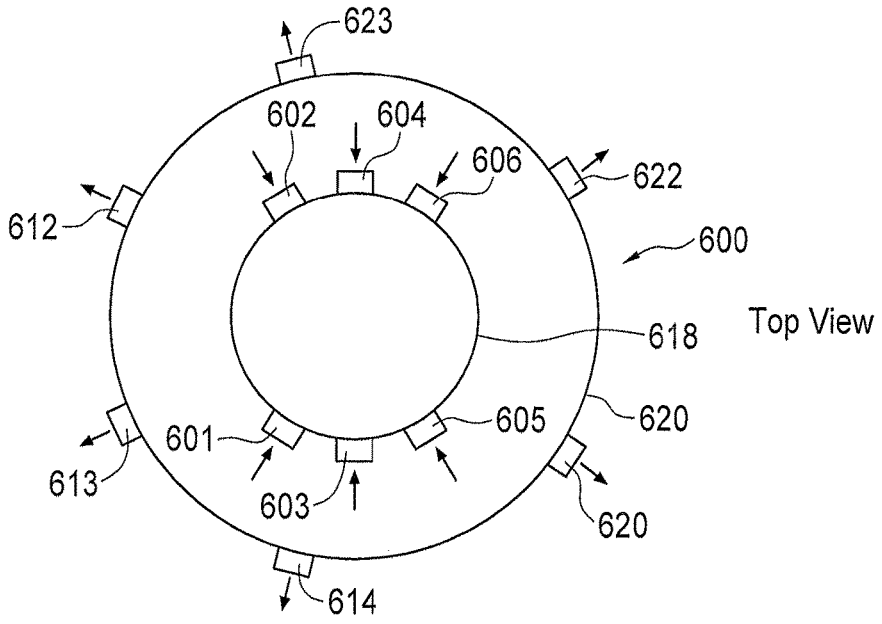
FIG. 6A and FIG. 6B are a top view and side view, respectively, of another embodiment of a slurry distributor useful in the present invention.
Figure 6B:
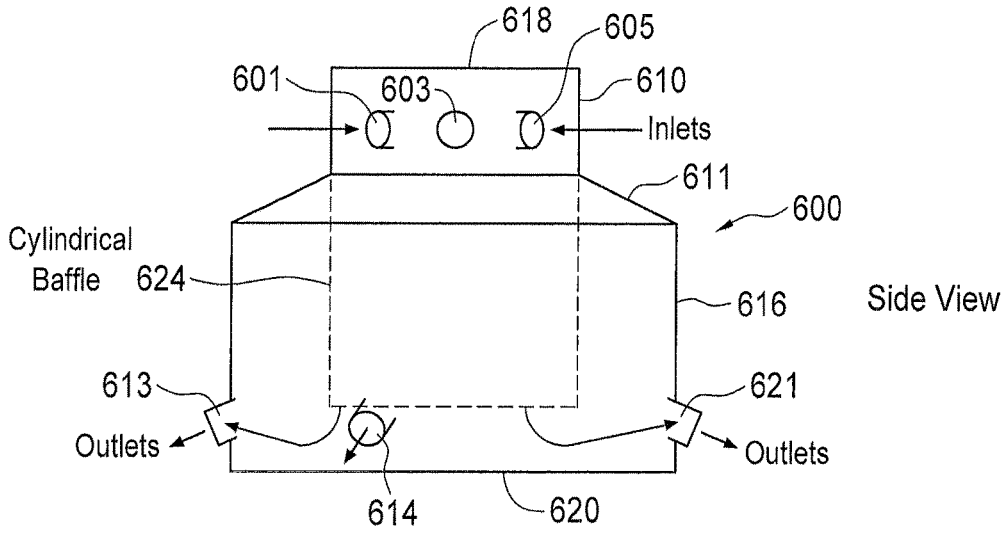

FIG. 6A and FIG. 6B are illustrations of a top view and side view, respectively, of another slurry distributor useful in the present invention. In this embodiment, slurry distributor 600 comprises an substantially cylindrical upper portion 610, a substantially frustoconical mid section 611, and a substantially cylindrical bottom section 616, where the diameter of the bottom section 616 is substantially greater than the diameter of the upper portion 610. Inside the slurry distributor 600 is a substantially cylindrical baffle 624.

In this embodiment, there are six inlet pipes 601, 602, 603, 604, 605 and 606, located near the top 618 of the slurry distributor 600 extending substantially perpendicularly from the cylindrical upper portion 610. Slurry distributor 600 is also a closed top vessel with a vent to prevent excessive moisture venting inside the building and heating the building up, as well as contributing to corrosion. There are also six outlet pipes 612, 613, 614, 621, 622 and 623 located near the closed bottom 620 of the slurry distributor 600 extending substantially perpendicularly from the cylindrical bottom section 616.

Slurry distributor 600 may be installed above six primary separation vessels and the mixed conditioned oil sand slurry flows by gravity through outlet feed lines (not shown) which are connected to each outlet pipe of the slurry distributor 600 and feedwells of corresponding primary separation vessels. The flow to the primary separation vessels may be controlled by means of valves. The cylindrical baffle 624, which is located inside the slurry distributor 600, reduces violent mixing and short circuiting of incoming flows at low operating levels, which would result in an adverse flow distribution between the discharge ports. Thus, the presence of the skirt baffle significantly reduces the turbulent eddy scale as well as the intensity in the distributor body, but especially in the annular space and at the discharge ports.

We claim:

1. A process for operating multiple oil sand mine sites for extracting bitumen from oil sand, comprising:

(a) preparing a first conditioned oil sand slurry at a first mine site using a first slurry preparation and conditioning process and subjecting the first conditioned oil sand slurry to a first bitumen separation process to produce a first bitumen froth;

(b) preparing a second conditioned oil sand slurry at a second mine site using a second slurry preparation and conditioning process and subjecting the second conditioned oil sand slurry to a second bitumen separation process to produce a second bitumen froth;

(c) combining the first bitumen froth and the second bitumen froth in at least one froth storage tank to produce a combined bitumen froth; and (d) subjecting the combined bitumen froth to further treatment to reduce the solids and water content therein.

2. The process as claimed in claim 1, wherein the first bitumen froth and the second bitumen froth are deaerated prior to combining them in the at least one froth storage tank.

3. The process as claimed in claim 1, wherein the first bitumen froth is heated prior to combining it with the second bitumen froth.

4. The process as claimed in claim 1, wherein the first mine site is remote from the second mine site and the first bitumen froth is transported to the second mine site by means of a froth pipeline.

5. The process as claimed in claim 1, wherein the further treatment comprises naphthenic froth treatment to produce naphtha diluted bitumen.

* * * * *